United States Patent [19]

Okunami

[11] Patent Number: 4,895,299

[45] Date of Patent: Jan. 23, 1990

[54] MAIL BOX WITH SIGNALLING DEVICE

[76] Inventor: Hideo Okunami, 10112 Park View Dr., Palos Park, Ill. 60464

[21] Appl. No.: 332,332

[22] Filed: Apr. 3, 1989

[51] Int. Cl.[4] ..... B65D 91/00; A47G 29/12

[52] U.S. Cl. ..... 232/35; 232/34

[58] Field of Search ..... 232/34, 35, 17

[56] References Cited

U.S. PATENT DOCUMENTS

| | | | |
|---|---|---|---|
| 2,581,880 | 1/1952 | Price | 232/35 |
| 3,080,107 | 3/1963 | Lindahl | 232/35 |
| 3,750,939 | 8/1973 | Hallett | 232/35 |
| 4,051,997 | 10/1977 | Garcia | 232/35 |
| 4,382,541 | 5/1983 | Miller | 232/35 |
| 4,754,918 | 7/1988 | Rolirad | 232/35 |
| 4,771,941 | 9/1988 | Bowman et al. | 232/35 |

*Primary Examiner*—Robert W. Gibson, Jr.
*Attorney, Agent, or Firm*—Wallenstein, Wagner & Hattis, Ltd.

[57] ABSTRACT

The invention is to be used in combination with a mail box having an open-ended mail receiving compartment and a closure pivotally mounted at the open end of that compartment for opening and closing its open end. The invention is a signalling device comprising signalling means having an indicia bearing portion and an activating portion which overlies at least in part the closure of the mail box when the closure is in its normally closed position. The activating portion of the signalling means is adapted to be engaged by the closure when it is pivoted away from the open end of the mail receiving compartment of the mail box. Retention means for engaging the indicia bearing portion of the signalling means are mounted at a position in relation to the mail box which is remote from the closure, and are adapted to release the indicia bearing portion of the signalling means in response to the force placed on the activating portion of the signalling means by the closure when it is pivoted away from the open end of the mail receiving compartment.

4 Claims, 2 Drawing Sheets

14
16
10
5
37
30
38
37
46
12
40
18
54
52
48
22
42
36
34

10
54
37
38
52
22
26
48

26
62
56
30
56
38
62
44
58
58
42
36

37
56
56
50
37
9
58
56
50
54
44
38
34
36
22
58
30
32
58
38
9

39
60
54
30
36

MAIL BOX WITH SIGNALLING DEVICE

DESCRIPTION

Technical Field

The invention relates generally to a mail box of the type mounted on a post, or the like support means, and positioned some distance away from the dwelling to which the mail is addressed, and which includes a pivotally secured signalling device.

Background of the Invention

Mail boxes of the type commonly used by persons living in rural or suburban areas comprise a mail-receiving compartment defined by a relatively elongated housing, or body portion. The open or front end of this housing includes a pivotally mounted closure or door. The base of the box is usually secured to a post or other support means, the end of which is buried in the ground. The mail box is typically located alongside a road so that mail can be deposited in the box by a mail deliverer without the need to leave the vehicle used for mail delivery.

Because the mail box is typically placed adjacent a road, the person retrieving the mail must leave his house or dwelling and walk to and from the mail box. Depending on the location of the house, the walk can be from several feet to several hundred feet. This walk is needless if no mail has been delivered. Walking to what proves to be an empty mail box can at best be frustrating and, in rain, snow, or freezing ground conditions, potentially dangerous to the elderly or to handicapped persons. Various signalling means are shown in the prior art. This prior art includes the following United States Patents: U.S. Pat. No. 2,609,787, issued to Lawson on Sept. 9, 1952; U.S. Pat. No. 3,547,070, issued to Schub on Dec. 15, 1970; U.S. Pat. No. 3,426,966, issued to Lay on Feb. 11, 1969; U.S. Pat. No. 3,408,978, issued to Duffey on Nov. 5, 1968; and U.S. Pat. No. 1,839,834, issued to Coleman on Jan. 5, 1932. Yet another signalling device was described in a U.S. patent application filed by the inventor of the present invention. This device was described in U.S. patent application Ser. No. 776,397, filed by Hideo Okunami on Sept. 16, 1985. This application was abandoned, as noted in Paper Number 3, "Notice of Abandonment," mailed from the Patent Office on July 22, 1986.

SUMMARY OF THE INVENTION

The invention is used in combination with a mail box having an open-ended mail receiving compartment and a closure pivotally mounted at the open end of that compartment for opening and closing the open end thereof. The mail box itself is adapted to be located some distance from a dwelling, and it is necessary to leave the dwelling to retrieve mail deposited in that box by a mail delivery person.

The signalling device of the invention comprises signalling means having an indicia bearing portion and an activating portion which overlies at least in part the closure of the mail box when the closure is in its normally closed position with relation to the open end of the mail-receiving compartment of the mail box. The activating portion of the signalling means is adapted to be engaged by the closure when it is pivoted away from the open end of the mail receiving compartment of the mail box.

Also provided are retention means for engaging the indicia bearing portion of the signalling means. The retention means are mounted at a position in relation to the mail box which is remote from the closure. The retention means are adapted to release the indicia bearing portion of the signalling means in response to the force placed on the activating portion of the signalling means by the closure when it is pivoted away from the open end of the mail receiving compartment of the mail box.

In yet another embodiment of the invention, the signalling means comprises a metal portion which is magnetically attractive.

In a still further embodiment, the retention means comprises a magnet for attracting the metal portion of the signalling means.

In yet another embodiment, the signalling means comprises a generally L-shaped member, one leg of which is adapted to overlie at least in part the closure when it is in its normally closed position.

DETAILED DESCRIPTION OF THE PREFERRED EMBODIMENT

Figure 1:
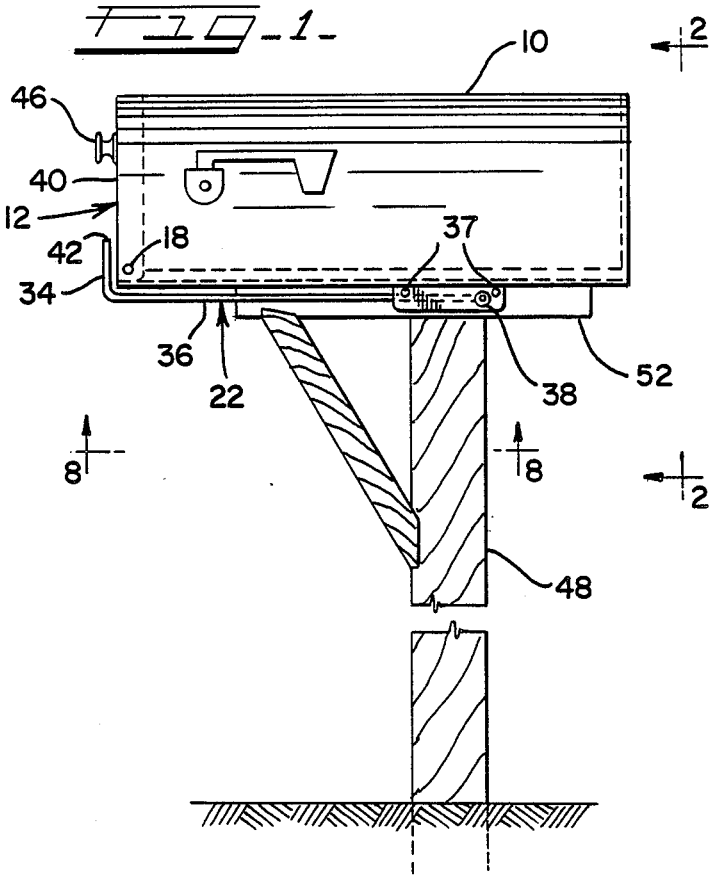
FIG. 1 is a side view of the signalling means in accordance with the invention in its normal, horizontal position, and supported by mail box.

Referring now to FIG. 1, the present invention comprises signalling means which are used in combination with a mail box 10 normally mounted on a post 48 and having a mail receiving compartment 16. The mail box includes an open end 14 for access to the mail receiving compartment 16. It also includes a closure 12 pivotally mounted about pivot 18 to the mail box 10. This closure 12, which is adjacent the open end 14, permits access to the mail receiving compartment 16 of the mail box 10.

The mail box 10 itself is adapted to be located some distance from a dwelling, and it is necessary to leave the dwelling to retrieve mail deposited in that box.

The signalling means 22 may comprises a generally L-shaped member, one leg of which is adapted to overlie at least in part the closure 12 when it is in its normally closed position. In particular, the signalling device in accordance with the invention comprises signalling means 22 having an indicia bearing portion or second leg 36, and an activating portion or first leg 34. The activating portion or first leg 34 overlies at least a part of the closure 12 of the mail box when the closure 12 is in its normally closed position (FIG. 1).

The invention includes retention means 30 for engaging the second leg 36. The retention means 30 are fixedly secured to the mail box (see FIG. 7), and at a position remote from the closure 12.

The retention means 30 are adapted to release the second leg 36 of the signalling means 22 in response to the force placed on the first leg or activating portion 34 by the closure 12 when it is pivoted away from the open end 14 of the mail receiving compartment 16.

Figure 3:
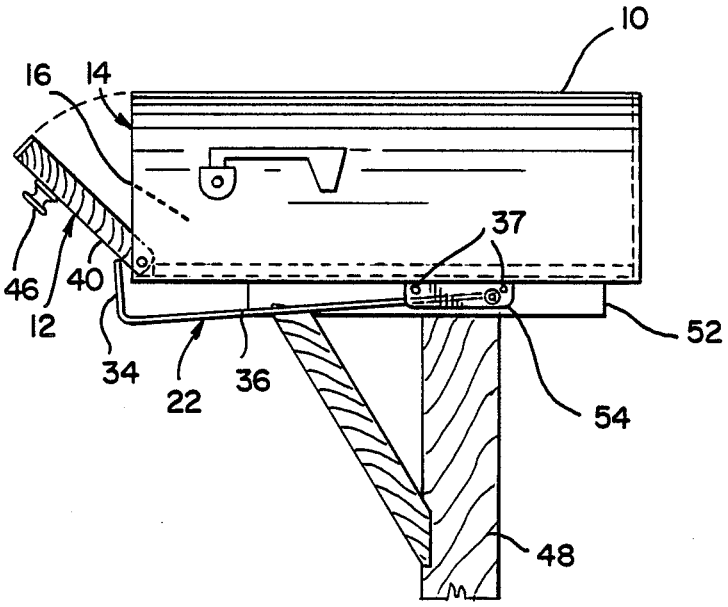
FIG. 3 is a side view of the signalling means and mail box of FIG. 1, but showing the closure of the mail box being moved from its normally closed to an open position, whereby the closure urges the signalling means into a vertical position away from the bottom of the mail box.

In this embodiment, this relationship is shown in FIG. 3. There, the first leg or activating portion 34 of the signalling means 22 is adapted to be engaged by the closure 12. In particular, when the closure 12 is pivoted away from the open end 14 of the mail receiving compartment 16, a side wall 40 of the closure 12 engages the distal end 42 of the first leg 34.

In one embodiment of the invention, the signalling means 22 may be made entirely of metal. In yet another embodiment, the signalling means 22 may comprise a metal portion 32 (FIG. 6) which is magnetically attractive. The remainder of the signalling means in this latter embodiment may be made of a non-ferrous material, such as a plastic.

In either of these embodiments, the retention means 30 comprises a magnet 44 for attracting the metal portion of the signalling means 22. The magnetic force generated by this magnet 44 is sufficient to support the weight of and the natural forces, such as winds and vibration, acting upon those signalling means 22. The magnetic force generated is, however, inadequate to prevent the separation of the signalling means 22 from the magnet 44 when the distal end 42 of the first leg 34 is engaged by the side wall 40 of the pivoting closure 12, as shown in FIG. 3.

Figure 2:
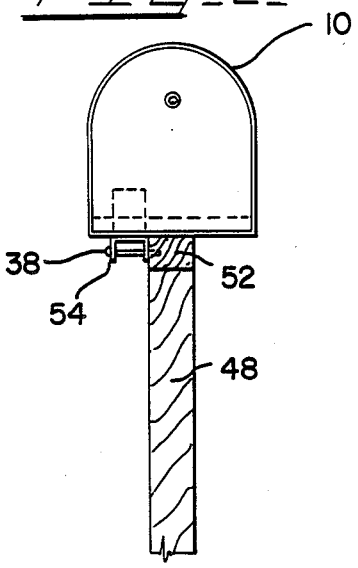
FIG. 2 is a rear view, taken along lines 2—2 of FIG. 1, of the signalling means and mail box of FIG. 1.

With this understanding of the structure of the present invention, its operation may be described. In particular, FIGS. 1 and 2 show the relative positions of the mail box 10 and the signalling means under normal circumstances, i.e., when there is no mail in the box. The rear portion of the box 10, as may be seen in FIG. 2, will face the owner's house or dwelling. Under such normal circumstances, therefore, the second leg 36 of the signalling means 22 is parallel to the floor of the mail receiving compartment 16.

As may be seen in FIG. 3, when mail is delivered, a knob 46 is pulled upon by the deliverer, pivoting the closure 12 about its pivotal mounting 18. Side wall 40 of the closure 12 then contacts the distal end 42 (FIG. 1) of first leg 34. As the closure 12 is opened completely (FIG. 4), its side wall 40 urges first leg 34 downwardly. As a result, second leg 36 moves about its pivot, which is in this embodiment formed by a rivet 38, and is forced away from the magnet 44.

Figures 4, 5, 6, 7, 8, 9:
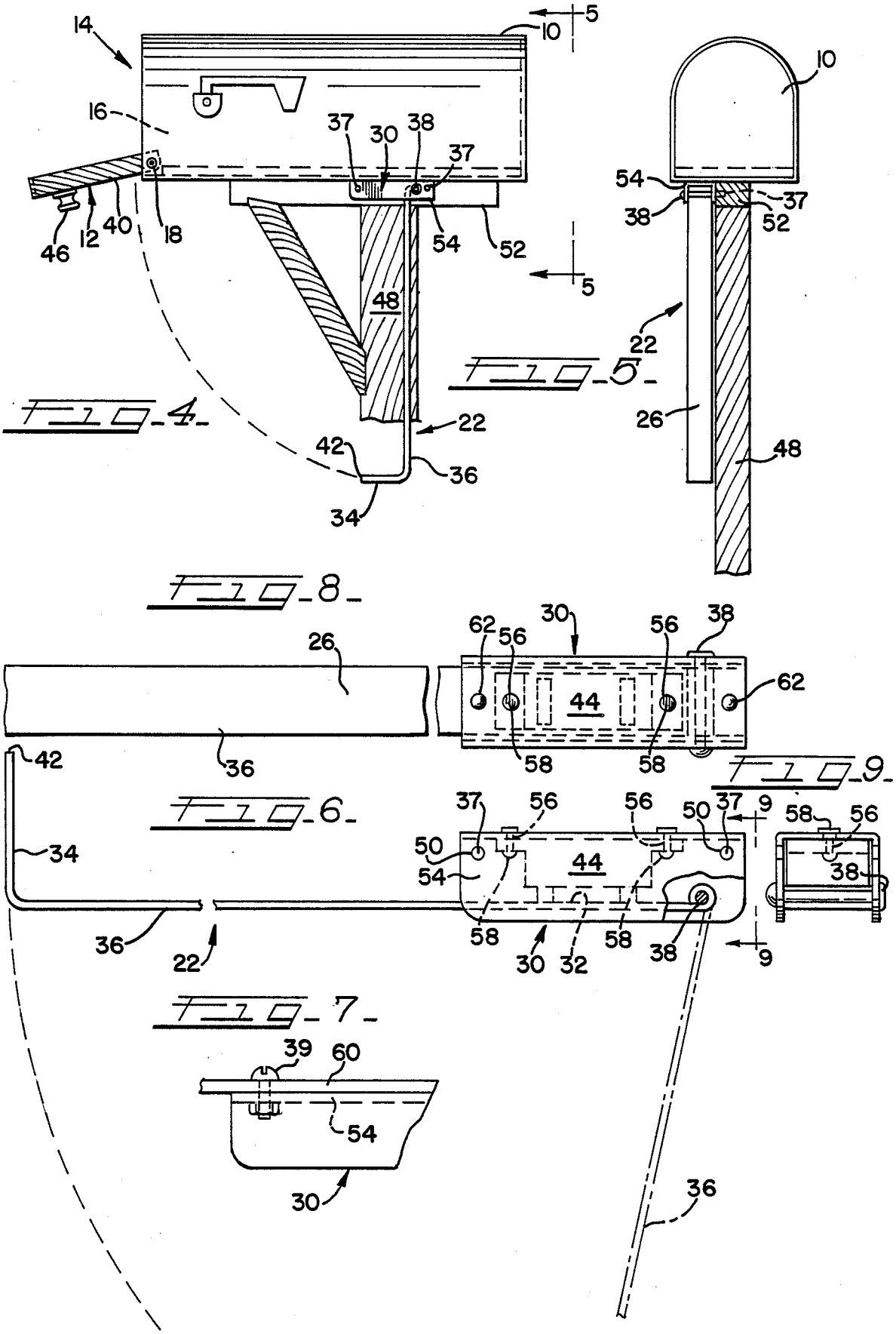
FIG. 4 is a side view of the signalling means and mail box of FIG. 3, and showing the closure of the mail box in its fully open position, with the signalling means into its vertical, fully extended position for indicating to the user that there is mail in the mail box.
FIG. 5 is a rear view, taken along lines 5—5 of FIG. 4, of the extended signalling mean and mail box of FIG. 4.
FIG. 6 is an enlarged view of the lower portion of FIG. 1, showing the signalling means and, in phantom, the retention means in accordance with one preferred embodiment of the invention.
FIG. 7 is a side view of the means for securing the bracket to the underside of the mail box.
FIG. 8 is an enlarged view of the signalling means of FIG. 1, and taken along lines 8—8 of FIG 1; and, FIG. 9 is a rear view of the retention means portion of FIG. 6, taken along lines 9—9 of FIG. 6.

The signalling means 22 is not now supported by magnetic force, and is thus no longer maintained in its horizontal position. Rather, it hangs from pivot 38 with its second leg 36 in a substantially vertical position (FIGS. 4 and 5). The home owner looking out towards his mail box 10 will see the view shown in FIG. 5. Particularly, the indicia bearing portion or second leg 36 of signalling means 22 will face the homeowner. Indicia 26, such as contrasting letters forming the phrase "Mail Time," may be molded or adhered onto the indicia-bearing portion to more distinctly alert the homeowner to the presence of mail in the mail box 10.

The device in accordance with the present embodiment permits signalling means 22 to be mounted in one of three different ways. As may be seen in FIGS. 1–5, the signalling means 22 may be mounted, when viewing the mailbox from the front, to the right of the post 48. The signalling means is mounted to a cross-piece 52 with screws 37. Four holes 50 are provided, two on each side of a bracket 54 (FIG. 6), for enabling the mounting of the signalling means 22, on either the right or left side of the post 48, to the cross-piece 52 with screws 37. As may be seen in FIG. 5, the ends of the screws 37 enter the cross-piece to secure the signalling means 22 to the post.

The holes 50 may be of uniform size. Under such conditions, the holes 50 also permit the signalling means 22 to be easily mounted on the left side of the post 48 (this mounting is not shown). If it were, however, the placement of the signalling means 22 and screws 37 would appear in a drawing as a mirror image of their placement in FIG. 5.

Alternatively, two holes 62 are provided in the base of the bracket 54 (FIGS. 6 and 7). These holes 62 enable screws 39 (FIG. 7) to secure bracket 54 and its signalling means to the base plate 60 of mailbox 10.

Two holes 56 (FIGS. 6, 8, and 9) are also provided in the base of bracket 54. Each of these two holes receives a rivet 58 to secure the magnet 44 to bracket 54.

While the specific embodiment has been illustrated and described, numerous modifications come to mind without markedly departing from the spirit of the invention. The scope of protection is thus only intended to be limited by the scope of the accompanying claims.

What I claimed is:

1. In combination with a mail box having an open-ended mail receiving compartment and a closure pivotally mounted at the open end of said compartment for opening and closing the open end thereof, said mail box being adapted to be located some distance from a dwelling whereby it is necessary to leave the dwelling to retrieve mail deposited therein by a mail delivery person, a signalling device comprising: one-piece signalling means having an indicia bearing portion and an activating portion which overlies at least in part the closure of the mail box when the closure is in its normally closed position with relation to the open end of the mail-receiving compartment of the mail box, said activating portion of the signalling means being adapted to be engaged by the closure when it is pivoted away from the open end of the mail receiving compartment of the mail box, and retention means for engaging the indicia bearing portion of the signalling means, said retention means being mounted at a position in relation to the mail box which is remote from said closure and being adapted to release the indicia bearing portion of the signalling means in response to the force placed on the activating portion of the signalling means by the closure when it is pivoted away from the open end of the mail receiving compartment of the mail box.

2. The combination of claim 1 wherein the signalling means comprises a metal portion which is magnetically attractive.

3. The combination of claim 2 wherein the retention means comprises a magnet for attracting the metal portion of the signalling means.

4. The combination of claim 1 wherein the signalling means comprises a generally L-shaped member, one leg of which is adapted to overlie at least in part the closure when it is in its normally closed position.

* * * * *